US007091170B2

(12) United States Patent
Kaneko

(10) Patent No.: US 7,091,170 B2
(45) Date of Patent: Aug. 15, 2006

(54) SOLVENT COMPOSITION FOR WASHING

(75) Inventor: Akiyasu Kaneko, Saitama (JP)

(73) Assignee: Kaneko Chemical Co., Ltd., Saitama (JP)

( * ) Notice: Subject to any disclaimer, the term of this patent is extended or adjusted under 35 U.S.C. 154(b) by 167 days.

(21) Appl. No.: 10/467,581

(22) PCT Filed: Feb. 14, 2002

(86) PCT No.: PCT/JP02/01258

§ 371 (c)(1),
(2), (4) Date: Dec. 12, 2003

(87) PCT Pub. No.: WO02/064724

PCT Pub. Date: Aug. 22, 2002

(65) Prior Publication Data

US 2005/0075264 A1 Apr. 7, 2005

(30) Foreign Application Priority Data

Feb. 14, 2001 (JP) ..... 2001-037650
Oct. 22, 2001 (JP) ..... 2001-323545

(51) Int. Cl.
*C11D 7/50* (2006.01)

(52) U.S. Cl. ..... 510/407; 510/177; 510/365; 510/408

(58) Field of Classification Search ..... None
See application file for complete search history.

(56) References Cited

U.S. PATENT DOCUMENTS

| | | | | |
|---|---|---|---|---|
| 5,268,120 | A | 12/1993 | Michaud | |
| 5,268,121 | A | 12/1993 | Michaud | |
| 5,348,681 | A * | 9/1994 | Desbiendras et al. | 510/177 |
| 5,350,534 | A * | 9/1994 | Michaud | 510/177 |
| 5,714,298 | A * | 2/1998 | Barthelemy et al. | 430/124 |
| 5,973,055 | A * | 10/1999 | Michaud et al. | 524/462 |
| 6,174,850 | B1 * | 1/2001 | Michaud | 510/415 |
| 6,291,416 | B1 * | 9/2001 | Michaud et al. | 510/411 |
| 6,303,668 | B1 * | 10/2001 | Barthelemy et al. | 521/131 |
| 6,403,550 | B1 * | 6/2002 | Bolmer et al. | 510/410 |
| 6,451,867 | B1 * | 9/2002 | Bogdan et al. | 521/131 |
| 6,489,277 | B1 * | 12/2002 | Michaud | 510/175 |

FOREIGN PATENT DOCUMENTS

| | | |
|---|---|---|
| EP | 885952 A1 | 12/1998 |
| JP | 05-171185 | 7/1993 |
| JP | 05-171189 | 7/1993 |
| JP | 05-171190 | 7/1993 |
| JP | 06-322394 | 11/1994 |
| JP | 07-188700 | 7/1995 |
| JP | 11-92792 | 4/1999 |
| JP | 11-152236 | 6/1999 |
| JP | 2000-154399 | 6/2000 |

OTHER PUBLICATIONS

International Search Report established and mailed May 21, 2002 for International Application No. PCT/JP02/01258, ISA/JPO.

* cited by examiner

*Primary Examiner*—Gregory Webb
(74) *Attorney, Agent, or Firm*—Harness, Dickey & Pierce, P.L.C.

(57) ABSTRACT

At least one kind of solvent selected from among nitromethane, nitroethane, d-limonene and 3-methoxybutyl acetate is mixed to 1,1,1,3,3-pentafluorobutane to such an extent as not imparting any flammability. Also, propylene glycol based solvent(s) is mixed to 1,1,1,3,3-pentafluorobutane to such an extent as not imparting any flammability.

2 Claims, No Drawings

SOLVENT COMPOSITION FOR WASHING

DESCRIPTION

1. Technical Field

The present invention relates to a solvent composition for cleaning that takes 1,1,1,3,3-pentafluorobutane as a main ingredient and particularly relates to an art of improving the cleaning ability thereof.

2. Background Art (Conventional Art)

Conventionally, chlorine-based solvents that fluorine-based solvents have been widely used as, for example, flux cleaners, solvents for dry cleaning, degreasing cleaners, buffing cleaners, resist removing agents, or solvents for removing adhesion water. However, chlorine-based solvents are substances causing ground water pollution, and fluorine-based solvents are substances causing ozone layer depletion; because of their environmental problems, the use thereof is becoming restricted. Therefore, there is a demand from various fields for a new solvent that would taken place of the above-mentioned solvents.

1,1,1,3,3-pentafluorobutane (365 mfc, chemical formula: $C_4H_5F_5$) is one such solvent (see, for example, Japanese Patent Application Laid-open Publication No. 5-171189, Japanese Patent Application Laid-open Publication No. 5-171190, Japanese Patent Application Laid-open Publication No. 6-322394, or Japanese Patent Application Laid-open Publication No. 7-188700). 1,1,1,3,3-pentafluorobutane has superior characteristics in that it does not include chlorine in its molecular structure, its ozone depletion potential (ODP) is zero, it is low in toxicity, its global warming potential (GWP) is also small, and thus it is ecological and clean.

(Conventional Problems)

However, 1,1,1,3,3-pentafluorobutane (365 mfc) has a problem in that its KB value (kauri-butanol value) is approximately 14, which is extremely low, and that it almost has no degreasing ability. If the KB value is low, it will not be possible to exert the sufficient cleaning ability required of various kinds of cleaners.

Therefore, proposals have been made to increase the cleaning ability by mixing, to 1,1,1,3,3-pentafluorobutane, methylene chloride or 1,1-dichloro-1-fluoroethane (HCFC-141b), which have a higher KB value and degreasing-cleaning ability than the above (see publications Japanese Patent Application Laid-open Publication No. 5-171185 and Japanese Patent Application Laid-open Publication No. 11-152236).

However, since methylene chloride is highly toxic, there are concerns about its band influence on the human body during execution of work. Therefore, use thereof is not only preferable, but there is also a possibility that it will become subjected to regulation in the future and become difficult to use. Further, 1,1-dichloro-1-fluoroethane (141b) has a high ozone depletion potential and is already subjected to regulation.

(OBJECT OF THE INVENTION)

The present invention has been made in view of such circumstances, and a first object thereof is to obtain a solvent composition for cleaning that takes 1,1,1,3,3-pentafluorobutane as a main ingredient and is superior in cleaning ability, and particularly degreasing-cleaning ability.

Objects and features of the present invention other than the above will become clear through the description of the present description and the appended drawings.

<DISCLOSURE OF INVENTION>

In order to accomplish the object mentioned above, the present invention disclosure a structure as follows.

The first structure of the present invention is characterized in including: (a) 1,1,1,3,3-pentafluorobutane; and (b) at least one kind of solvent selected from among nitromethane, nitroethane, d-limonene, and 3-methoxybutyl acetate, and having no flammability.

Nitromethane, nitroethane, d-limonene, and 3-methoxybutyl acetate are such solvents found by the present inventor as to be suitable for increasing the cleaning ability of 1,1,1,3,3-pentafluorobutane. These solvents have superior degreasing-cleaning abilities.

Further, the second structure of the present invention is characterized in including: (a) 30 through 70 wt % of 1,1,1,3,3-pentafluorobutane; and (b) 30 through 70 wt % of one kind of solvent or a mixed solvent including at least two kinds of solvents selected from among nitromethane, nitroethane, d-limonene, and 3-methoxybutyl acetate.

The range of 1,1,1,3,3-pentafluorobutane is set to 30 through 70 wt % and the range of one kind of solvent or a mixed solvent including at least two kinds of solvents selected from among nitromethane, nitroethane, d-limonene, and 3-methoxybutyl acetate is set to 30 through 70 wt % because, if the contents of the latter to too small, it is not possible to increase the cleaning ability much, and thus it is not possible to obtain a sufficient cleaning effect. Further, this is because, if the content of the latter is too large, the characteristics of nitromethane, nitroethane, d-limonene, and 3-methoxybutyl acetate will become too significant, and flammability will be imparted and the solvent component will turn into a combustible.

Further, the third main structure of the present invention is characterized in including: (a) 30 through 60 wt % of 1,1,1,3,3-pentafluorobutane; and (b) 40 through 70 wt % of one kind of solvent or a mixed solvent including at least two kinds of solvents selected from among nitromethane, nitroethane, d-limonene, and 3-methoxybutyl acetate. With this structure, it is possible to sufficiently support flux cleaning.

Further, the fourth main structure of the present invention is characterized in including: (a) 1,1,1,3,3-pentafluorobutane; and (c) a propylene glycol based solvent, and having no flammability.

Propylene glycol based solvents are such solvents formed by the present inventor as to be suitable for increasing the cleaning ability of 1,1,1,3,3-pentafluorobutane. Propylene glycol based solvents have an extremely high dissolution ability and are superior in degreasing cleaning. Further, propylene glycol based solvents are not toxic and thus extremely safe and easy to handle. Further, they do not have chlorine or fluorine in their molecular structure and their ozone depletion potential (ODP) and global warming potential (GDP) are small, and therefore, they have superior characteristics in that they are ecological and clean. By mixing such a solvent to 1,1,1,3,3-pentafluorobutane, it is possible to greatly increase the cleaning ability, especially the degreasing-cleaning ability, and it is possible to fully achieve sufficient performances as various kinds of cleaners.

Propylene glycol based solvents, however, have a drawback in that they have flammability and thus are combustibles. On the other hand, 1,1,1,3,3-pentafluorobutane has no flammability and is a non-combustible. Therefore, through mixing the former with these non-combustible solvents, the solvent composition can be made into a safe non-combustible that has no flammability.

Further, the fifth main structure of the present invention is characterized in including: (a) 10 through 80 wt % of 1,1,1,3,3-pentafluorobutane; and (c) 20 through 90 wt % of one kind or at least two kinds of propylene glycol based solvents.

The range of 1,1,1,3,3-pentafluorobutane is set to 10 through 80 wt % and the range of the propylene glycol based solvent is set to 20 through 90 wt % because, if the contents of the propylene glycol based solvent is too small, the cleaning ability will not improve much, and thus it is not possible to obtain a sufficient cleaning effect. Further, this is because, if the content of the propylene glycol based solvent is too large, there is a possibility that flammability will be imparted to the solvent composition and it will turn into a combustible. By setting the blending amount as described above, it is possible to obtain a solvent composition for cleaning that has a sufficient cleaning ability but has not flammability.

Further, the sixth main structure of the present invention is characterized in including: (a) 10 through 70 wt % of 1,1,1,3,3-pentafluorobutane; and (c) 30 through 90 wt % of one kind or at least two kinds of propylene glycol based solvents. With this structure, it is possible to sufficiently support flux cleaning.

Further, in the fourth through sixth main structures of the present invention, it is characteristic that (d) at least one kind of solvent selected from among nitromethane, nitroethane, 3-methoxybutyl acetate, 3-methoxy-1-butanol, and d-limonene is included.

Further, in the fourth through sixth main structures of the present invention, it is characteristic that (d) at least 5 wt % of at least one kind of solvent selected from among nitromethane, nitroethane, 3-methoxybutyl acetate, 3-methoxy-1-butanol, and d-limonene is included.

By including nitromethane, nitroethane, 3-methoxybutyl acetate, 3-methoxy-1-butanol, or d-limonene as explained above, it is possible to further increase the dissolution ability, and thus it is possible to fully achieve a superior cleaning ability.

<BEST MODE FOR CARRYING OUT THE INVENTION>

An embodiment of a solvent composition for cleaning according to the present invention will be described below. The solvent composition for cleaning according to the present invention includes the following five types:

[1] a solvent composition for cleaning that has no flammability and that includes (a) 1,1,1,3,3-pentafluorobutane and (b) at least one kind of solvent selected from among nitromethane, nitroethane, d-limonene, and 3-methoxybutyl acetate;

[2] a solvent composition for cleaning that includes (a) 30 through 70 wt % of 1,1,1,3,3-pentafluorobutane and (b) 30 through 70 wt % of one kind of solvent or a mixed solvent including at least two kinds of solvents selected from among nitromethane, nitroethane, d-limonene, and 3-methoxybutyl acetate;

[3] a solvent composition for cleaning that includes (a) 30 through 60 wt % of 1,1,1,3,3-pentafluorobutane and (b) 40 through 70 wt % of one kind of solvent or a mixed solvent including at least two kinds of solvents selected from among nitromethane, nitroethane, d-limonene, and 3-methoxybutyl acetate;

[4] a solvent composition for cleaning that has no flammability and that includes (a) 1,1,1,3,3-pentafluorobutane and (c) a propylene glycol based solvent;

[5] a solvent composition for cleaning that includes (a) 10 through 80 wt % 1,1,1,3,3-pentafluorobutane and (c) 20 through 90 wt % of one kind or at least two kinds of propylene glycol based solvents;

[6] a solvent composition for cleaning that includes (a) 10 through 70 wt % of 1,1,1,3,3-pentafluorobutane and (c) 30 through 90 wt % of one kind or at least two kinds of propylene glycol based solvents;

[7] a solvent composition for cleaning that includes, in the solvent composition for cleaning according to [4] through [6], (d) at least one kind of solvent selected from among nitromethane, nitroethane, 3-methoxybutyl acetate, 3-methoxy-1-butanol, and d-limonene.

As for nitromethane, nitroethane, d-limonene, 3-methoxybutyl acetate, or 3-methoxy-1-butanol in the solvent compositions for cleaning according to [1] through [3], [6], and [7], it is only necessary for at least one kind of solvent from among the above to be mixed; however, it is needless to say that two or more types can be selected from among the above and mixed.

As for the mixing amount of nitromethane, nitroethane, d-limonene, and 3-methoxybutyl acetate in the solvent composition for cleaning according to [7], it is preferable to set the lower limit value thereof to at least 5 wt % because sufficient improvement in cleaning ability cannot be accomplished if the amount is too small. Further, since there is a possibility that flammability will arise if the mixing amount of the solvent is too large an amount, it is preferable to appropriately mix the solvent to an extent that flammability will be imparted. Further, since the solvents mentioned above are expensive compared to propylene glycol based solvents, it is preferable to keep the usage amount thereof as low as possible.

Specifically, the propylene glycol based solvents used in the solvent compositions for cleaning according to [4] through [7] include, for example: propylene glycol methyl ether [PM] (boiling point: 120° C., flash point : 34° C.); dipropylene glycol methyl ether [DPM] (boiling point: 188° C., flash point: 79° C.); tripropylene glycol methyl ether [TPM] (boiling point: 242° C., flash point: 122° C.); propylene glycol n-butyl ether [PnB] (boiling point: 170° C., flash point: 62° C.); dipropylene glycol n-butyl ether [DPnB] (boiling point: 229° C., flash point: 106° C.); tripropylene glycol n-butyl ether (boiling point: 274° C., flash point: 138° C.); propylene glycol methyl ether acetate [PMA] (boiling point: 146° C., flash point: 46.5° C.); propylene glycol diacetate [PGDA] (boiling point: 190° C., flash point: 93° C.); propylene glycol phenyl ether [PPh] (boiling point: 243° C., flash point: 121° C.); and propylene glycol monoethyl ether acetate (boiling point: 158° C., flash point: 53° C.). In terms of the propylene glycol based solvent, one kind may be mixed alone or several types may be mixed in combination.

Further, as for 1,1,1,3,3-pentafluorobutane, if the object to be cleaned is made of iron, zinc, aluminum, copper, brass, etc. when it is used for cleaning in a heated state or as steam, there are cases in which it becomes unstable because of an influence caused by the metal. Therefore, it is preferably to add, as a stabilizer, at least one kind of compound selected from nitro compounds, phenols, amines, ethers, amylenes, epoxides, or triazoles. Specifically, there are the following as stabilizers: epoxides such as propylene oxide, 1,2-butylene oxide, and glycidol; phosphites such as dimethyl phosphite, diisopropyl phosphite, and diphenyl phosphite; thiophosphites such as trilauryl trithiophosphite; phosphine sulfphides such as triphenoxyphosphine sulphide and trimethylphosphine sulphide; boron compounds such as boric acid, triethyl borate, triphenyl borate, phenylboronic acid, and diphenylboronic acid; phenols such as 2,6-di-tert-butyl-para-cresol; nitroalkanes such as nitromethane and nitroethane; acrylic esters such as methyl acrylate and ethyl acrylate; and also, dioxane, tert-butanol, pentaerythritol, and para-isopropenyl toluene. As for the amount of addition of these stabilizers, it is preferable to set the amount to 0.01 through 5.00 wt % of the whole amount of the solvent composition for cleaning, although the amount is not to be particularly limited.

Further, as main applications of the solvent composition for cleaning according to the present invention, it is possible to name, for example: resist removing agents, flux cleaners, degreasing cleaners for oils and fats etc., buffing cleaners, dissolution agents for adhesive agents (such as urethane, epoxy, and silicone), solvents for dry cleaning, removing agents for grease, oil, wax, ink etc., solvents for paint, extractants, cleaners for various articles made of glass, ceramics, rubber, metal etc. and particularly for IC parts, electrical equipments, precision equipments, optical lenses, etc., or water removing agents.

Further, in terms of the cleaning method to which the solvent composition for cleaning according to the present invention can be applied, it can be applied to, for example, manual wiping, immersion, spraying, ultrasonic cleaning, steam cleaning, and cleaning of nozzles of devices for filling adhesive agents (such as urethane, epoxy, and silicone) as well as to other general cleaning.

<<Machine Oil Cleaning Test (1)>>

In this test, test pieces made of SUS-304 (length 25 mm×width 30 mm×thickness 2 mm) were prepared, and, after immersing these test pieces into machine oil (CQ-30: made by Nippon Oil Co., Ltd.), they were immersed into each cleaning fluid for approximately 3 minutes. After subjecting the test pieces to a drying process, the cleansing state of the test pieces was studied. Solvents for cleaning obtained by mixing each of nitromethane, nitroethane, d-limonene, and 3-methoxybutyl acetate (3-MBA) to 1,1,1,3,3-pentafluorobutane (365 mfc) were used. The following table 1 summaries the composition of each cleaning fluid and the results of cleaning.

TABLE 1

MACHINE OIL CLEANING TEST 1 (365mfc, nitroethane, nitromethane, d-limonene, 3-MBA)

| | 365mfc (wt %) | nitroethane (wt %) | nitro-methane (wt %) | d-limonene (wt %) | 3-MBA (wt %) | cleaning ability |
|---|---|---|---|---|---|---|
| A | 80 | 20 | — | — | — | X |
| B | 75 | 25 | — | — | — | X |
| C | 70 | 30 | — | — | — | ○ |
| D | 65 | 35 | — | — | — | ○ |
| E | 60 | 40 | — | — | — | ○ |
| F | 50 | 50 | — | — | — | ○ |
| G | 80 | — | 20 | — | — | X |
| H | 75 | — | 25 | — | — | X |
| I | 70 | — | 30 | — | — | ○ |
| J | 65 | — | 35 | — | — | ○ |
| K | 60 | — | 40 | — | — | ○ |
| L | 50 | — | 50 | — | — | ○ |
| M | 80 | — | — | 20 | — | X |
| N | 75 | — | — | 25 | — | X |
| O | 70 | — | — | 30 | — | ○ |
| P | 65 | — | — | 35 | — | ○ |
| Q | 60 | — | — | 40 | — | ○ |
| R | 50 | — | — | 50 | — | ○ |

TABLE 1-continued

MACHINE OIL CLEANING TEST 1 (365mfc, nitroethane, nitromethane, d-limonene, 3-MBA)

| | 365mfc (wt %) | nitroethane (wt %) | nitro-methane (wt %) | d-limonene (wt %) | 3-MBA (wt %) | cleaning ability |
|---|---|---|---|---|---|---|
| S | 80 | — | — | — | 20 | X |
| T | 75 | — | — | — | 25 | X |
| U | 70 | — | — | — | 30 | ○ |
| V | 65 | — | — | — | 35 | ○ |
| W | 60 | — | — | — | 40 | ○ |
| Y | 50 | — | — | — | 50 | ○ |

○: good
X: cleaning effect small
365mfc: 1,1,1,3,3-pentafluorobutane ($C_4H_5F_5$)
3-MBA: 3-methoxybutyl acetate Further, a solvent obtained by mixing propylene glycol methyl ether [PM], as a propylene glycol based solvent, to 1,1,1,3,3-pentafluorobutane (365 mfc), a solvent obtained by mixing propylene glycol n-butyl ether [PnB], and a solvent obtained by mixing dipropylene glycol n-butyl ether [DPnB] were also studied, respectively. The test results are described in the following tables 2 through 4.

TABLE 2

MACHINE OIL CLEANING TEST 2 (365mfc, PM)

| | A | B | C | D | E | F | G | H | I | J |
|---|---|---|---|---|---|---|---|---|---|---|
| 365mfc (wt %) | 100 | 90 | 85 | 80 | 70 | 60 | 50 | 30 | 20 | 10 |
| PM (wt %) | 0 | 10 | 15 | 20 | 30 | 40 | 50 | 70 | 80 | 90 |
| cleaning results | X | X | X | ○ | ○ | ◎ | ◎ | ◎ | ◎ | ◎ |

X: cleaning effect small
○: good
◎: very good
365mfc: 1,1,1,3,3-pentafluorobutane ($C_4H_5F_5$)
PM: propylene glycol methyl ether

TABLE 3

MACHINE OIL CLEANING TEST 3 (365mfc, PnB)

| | A | B | C | D | E | F | G | H | I | J |
|---|---|---|---|---|---|---|---|---|---|---|
| 365mfc (wt %) | 100 | 90 | 85 | 80 | 70 | 60 | 50 | 30 | 20 | 10 |
| PnB (wt %) | 0 | 10 | 15 | 20 | 30 | 40 | 50 | 70 | 80 | 90 |
| cleaning results | X | X | X | ○ | ○ | ◎ | ◎ | ◎ | ◎ | ◎ |

X: cleaning effect small
○: good
◎: very good
365mfc: 1,1,1,3,3-pentafluorobutane ($C_4H_5F_5$)
PnB: propylene glycol n-butyl ether

TABLE 4

MACHINE OIL CLEANING TEST 4 (365mfc, DPnB)

| | A | B | C | D | E | F | G | H | I | J |
|---|---|---|---|---|---|---|---|---|---|---|
| 365mfc (wt %) | 100 | 90 | 85 | 80 | 70 | 60 | 50 | 30 | 20 | 10 |
| DPnB (wt %) | 0 | 10 | 15 | 20 | 30 | 40 | 50 | 70 | 80 | 90 |
| cleaning results | X | X | X | ○ | ○ | ◎ | ◎ | ◎ | ◎ | ◎ |

X: cleaning effect small
○: good
◎: very good
365mfc: 1,1,1,3,3-pentafluorobutane ($C_4H_5F_5$)
DPnB: dipropylene glycol n-butyl ether From these test results, it has been confirmed that the cleaning ability increases and cleaning of machine oil becomes possible by mixing nitromethane, nitroethane, d-limonene, 3-methoxybutyl acetate, or a propylene glycol based solvent to 1,1,1,3,3-pentafluorobutane. Further, in this case, it was found that it is necessary to set the mixing amount of nitromethane, nitroethane, d-limonene, and 3-methoxybutyl acetate to be at least 30 wt %. Further, it was found that it is necessary to set the mixing amount of the propylene glycol based solvents to be at least 20 wt %.

<<Flux Cleaning Test (1)>>

In this test, flux (TAMURA F-AL-4 made by TAMURA Corporation) was applied to the whole surface of a printed wiring board for testing, and, after subjecting it to a burning process in an electric furnace at approximately 200° C. for approximately 2 minutes, it was immersed into a cleaning fluid for approximately 3 minutes. Then, after subjecting the printing wiring board to a drying process, the cleansing state was examined. In terms of the cleaning fluid, tests were conducted for fluids obtained by mixing each of nitromethane, nitroethane, d-limonene, and 3-methoxybutyl acetate (3-MBA) to 1,1,1,3,3-pentafluorobutane (365 mfc), and for fluids obtained by mixing, as a propylene glycol based solvent, each of propylene glycol methyl ether [PM], propylene glycol n-butyl ether [PnB], or dipropylene glycol n-butyl ether [DPnB]. The test results are described in table 5 through table 8 below.

TABLE 5

Flux Cleaning Test 1 (365mfc, nitroethane, nitromethane, d-limonene, 3-MBA)

| | 365mfc (wt %) | nitroethane (wt %) | nitro-methane (wt %) | d-limonene (wt %) | 3-MBA (wt %) | cleaning ability |
|---|---|---|---|---|---|---|
| A | 80 | 20 | — | — | — | X |
| C | 70 | 30 | — | — | — | X |
| D | 65 | 35 | — | — | — | X |
| E | 60 | 40 | — | — | — | ○ |
| E | 50 | 50 | — | — | — | ○ |
| F | 40 | 60 | — | — | — | ○ |
| G | 30 | 70 | — | — | — | ○ |
| H | 20 | 80 | — | — | — | ○ |
| I | 80 | — | 20 | — | — | X |
| J | 70 | — | 30 | — | — | X |
| K | 65 | — | 35 | — | — | X |
| L | 60 | — | 40 | — | — | ○ |
| M | 50 | — | 50 | — | — | ○ |
| N | 40 | — | 60 | — | — | ○ |
| O | 30 | — | 70 | — | — | ○ |
| P | 20 | — | 80 | — | — | ○ |
| Q | 80 | — | — | 20 | — | X |
| R | 70 | — | — | 30 | — | X |
| S | 65 | — | — | 35 | — | X |
| T | 60 | — | — | 40 | — | ○ |
| U | 50 | — | — | 50 | — | ○ |
| V | 40 | — | — | 60 | — | ○ |
| W | 30 | — | — | 70 | — | ○ |
| X | 20 | — | — | 80 | — | ○ |
| Y | 10 | — | — | 90 | — | ○ |
| Z | 5 | — | — | 95 | — | ○ |
| AA | 80 | — | — | — | 20 | X |
| AB | 70 | — | — | — | 30 | X |
| AC | 65 | — | — | — | 35 | X |
| AD | 60 | — | — | — | 40 | ○ |
| AE | 50 | — | — | — | 50 | ○ |
| AF | 40 | — | — | — | 60 | ○ |
| AG | 30 | — | — | — | 70 | ○ |
| AH | 20 | — | — | — | 80 | ○ |
| AI | 10 | — | — | — | 90 | ○ |

○: good
X: cleaning effect small
365mfc: 1,1,1,3,3-pentafluorobutane ($C_4H_5F_5$)
3-MBA: 3-methoxybutyl acetate

TABLE 6

FLUX CLEANING TEST 2 (365mfc, PM)

| | A | B | C | D | E | F | G | H | I | J |
|---|---|---|---|---|---|---|---|---|---|---|
| 365mfc (wt %) | 100 | 90 | 80 | 75 | 70 | 60 | 55 | 50 | 40 | 30 |
| PM (wt %) | 0 | 10 | 20 | 25 | 30 | 40 | 45 | 50 | 60 | 70 |
| cleaning results | X | X | X | X | ○ | ◎ | ◎ | ◎ | ◎ | ◎ |

X: cleaning effect small
○: good
◎: very good
365mfc: 1,1,1,3,3-pentafluorobutane ($C_4H_5F_5$)
PM: propylene glycol methyl ether

TABLE 7

FLUX CLEANING TEST 3 (365mfc, PnB)

| | A | B | C | D | E | F | G | H | I | J |
|---|---|---|---|---|---|---|---|---|---|---|
| 365mfc (wt %) | 100 | 90 | 80 | 75 | 70 | 60 | 55 | 50 | 40 | 30 |
| PnB (wt %) | 0 | 10 | 20 | 25 | 30 | 40 | 45 | 50 | 60 | 70 |
| cleaning results | X | X | X | X | ○ | ◎ | ◎ | ◎ | ◎ | ◎ |

X: cleaning effect small
○: good
◎: very good
365mfc: 1,1,1,3,3-pentafluorobutane ($C_4H_5F_5$)
PnB: propylene glycol n-butyl ether

TABLE 8

FLUX CLEANING TEST 4 (365mfc, DPnB)

| | A | B | C | D | E | F | G | H | I | J |
|---|---|---|---|---|---|---|---|---|---|---|
| 365mfc (wt %) | 100 | 90 | 80 | 75 | 70 | 60 | 50 | 30 | 20 | 10 |
| DPnB (wt %) | 0 | 10 | 20 | 25 | 30 | 40 | 50 | 70 | 80 | 90 |
| cleaning results | X | X | X | X | ○ | ◎ | ◎ | ◎ | ◎ | ◎ |

X: cleaning effect small
○: good
◎: very good
365mfc: 1,1,1,3,3-pentafluorobutane ($C_4H_5F_5$)
DPnB: dipropylene glycol n-butyl ether From these test results, it has been confirmed that the cleaning ability increases and cleaning of flux becomes possible by mixing either nitromethane, nitroethane, d-limonene, 3-methoxybutyl acetate, or a propylene glycol based solvent. Further, it has been confirmed that it is necessary to mix at least 40 wt % of nitromethane, nitroethane, d-limonene, or 3-methoxybutyl acetate. Further, it has been confirmed that it is necessary to mix at least 30 wt % of propylene glycol based solvents.

<<Flammability Test>>

In this test, the flammability was studied for when each of nitromethane, nitroethane, d-limonene, 3-methoxybutyl acetate, or a propylene glycol based solvent was mixed to 1,1,1,3,3-pentafluorobutane. As described above, 1,1,1,3,3-pentafluorobutane has no flammability and is a non-combustible, were has nitromethane, nitroethane, d-limonene, 3-methoxybutyl acetate, and propylene glycol based solvents have flammability and are combustibles; therefore, when these are mixed, there is a possibility that the solvent may turn into a combustible. Therefore, in order to keep the flammability from being imparted, the appropriate mixing amount for nitromethane, nitroethane, d-limonene, 3-methoxybutyl acetate, or the propylene glycol based solvents was studied.

Here, in terms of cleaning fluid, fluid obtained by mixing each of nitromethane, nitroethane, d-limonene, and 3-methoxybutyl acetate to 1,1,1,3,3-pentafluorobutane, and fluid obtained by mixing, as a propylene glycol based solvent, each of propylene glycol methyl ether [PM], propylene glycol n-butyl ether [PnB], or dipropylene glycol n-butyl ether [DPnB] were prepared, and the relationship between the mixing amount and the flammability of the above was studied. The test results are shown in the following tables 9 through 12. Note that the flammability was studied according to the Tag closed cup method.

TABLE 9

FLAMMABILITY TEST 1 (365mfc, nitroethane, nitromethane, d-limonene, 3-MBA)

| | 365mfc (wt %) | nitroethane (wt %) | nitro-methane (wt %) | d-limonene (wt %) | 3-MBA (wt %) | flamma-bility |
|---|---|---|---|---|---|---|
| A | 70 | 30 | — | — | — | no |
| B | 60 | 40 | — | — | — | no |
| C | 50 | 50 | — | — | — | no |
| D | 40 | 60 | — | — | — | no |
| E | 30 | 70 | — | — | — | no |
| F | 20 | 80 | — | — | — | yes |
| G | 10 | 90 | — | — | — | yes |
| H | 70 | — | 30 | — | — | no |
| I | 60 | — | 40 | — | — | no |
| J | 50 | — | 50 | — | — | no |
| K | 40 | — | 60 | — | — | no |
| L | 30 | — | 70 | — | — | no |
| M | 20 | — | 80 | — | — | no |
| N | 10 | — | 90 | — | — | yes |
| O | 70 | — | — | 30 | — | no |
| P | 60 | — | — | 40 | — | no |
| Q | 50 | — | — | 50 | — | no |
| R | 40 | — | — | 60 | — | no |
| S | 30 | — | — | 70 | — | no |
| T | 20 | — | — | 80 | — | no |
| U | 10 | — | — | 90 | — | no |
| V | 5 | — | — | 95 | — | yes |
| W | 70 | — | — | — | 30 | no |
| Y | 60 | — | — | — | 40 | no |
| Z | 50 | — | — | — | 50 | no |
| AA | 40 | — | — | — | 60 | no |
| AB | 30 | — | — | — | 70 | no |
| AC | 20 | — | — | — | 80 | no |
| AD | 10 | — | — | — | 90 | no |
| AE | 5 | — | — | — | 95 | yes |

365mfc: 1,1.1.3,3-pentafluorobutane ($C_4H_5F_5$)
3-MBA: 3-methoxybutyl acetate

TABLE 10

FLAMMABILITY TEST 2 (365mfc. PM)

| | A | B | C | D | E | F | G | H | I | J |
|---|---|---|---|---|---|---|---|---|---|---|
| 365mfc (wt %) | 90 | 80 | 70 | 60 | 50 | 40 | 30 | 25 | 20 | 10 |
| PM (wt %) | 10 | 20 | 30 | 40 | 50 | 60 | 70 | 75 | 80 | 90 |
| flammability | no | no | no | no | no | no | no | no | yes | yes |

365mfc: 1,1,1,3,3-pentafluorobutane ($C_4H_5F_5$)
PM: propylene glycol methyl ether

TABLE 11

FLAMMABILITY TEST 3 (365mfc, PnB)

| | A | B | C | D | E | F | G | H | I | J |
|---|---|---|---|---|---|---|---|---|---|---|
| 365mfc (wt %) | 90 | 80 | 70 | 60 | 50 | 40 | 30 | 20 | 10 | 5 |
| PnB (wt %) | 10 | 20 | 30 | 40 | 50 | 60 | 70 | 80 | 90 | 95 |

TABLE 11-continued

FLAMMABILITY TEST 3 (365mfc, PnB)

| | A | B | C | D | E | F | G | H | I | J |
|---|---|---|---|---|---|---|---|---|---|---|
| flammability | no | no | no | no | no | no | no | no | no | yes |

365mfc: 1,1,1,3,3-pentafluorobutane ($C_4H_5F_5$)
PnB: propylene glycol n-butyl ether

TABLE 12

FLAMMABILITY TEST 4 (365mfc, DPnB)

| | A | B | C | D | E | F | G | H | I | J |
|---|---|---|---|---|---|---|---|---|---|---|
| 365mfc (wt %) | 90 | 80 | 70 | 60 | 50 | 40 | 30 | 20 | 10 | 5 |
| DPnB (wt %) | 10 | 20 | 30 | 40 | 50 | 60 | 70 | 80 | 90 | 95 |
| flammability | no | no | no | no | no | no | no | no | no | yes |

365mfc: 1,1,1,3,3-pentafluorobutane ($C_4H_5F_5$)
DPnB: dipropylene glycol n-butyl ether From these test results, it was found that, since flammability starts to be imparted at 80 wt % or more for nitromethane and nitroethane and at 95 wt % or more for d-limonene and 3-methoxybutyl acetate (3-MBA), it is necessary to set the content of nitromethane and nitroethane to be 70 wt % or lower and the content of d-limonene and 3-methoxybutyl acetate (3-MBA) to be 90 wt % or lower in order to keep the solvent from possessing flammability.

Further, as for propylene glycol methyl ether [PM], it was found that flammability is imparted when 80 wt % or more of this is mixed. Further, as for propylene glycol n-butyl ether [PnB] and dipropylene glycol n-butyl ether [DPnB], it was found that flammability is imparted when 95 wt % or more of this is mixed. From the above, it was found that it is necessary to keep the mixing amount to 75 wt % or lower for propylene glycol methyl ether [PM] and 90 wt % or lower for propylene glycol n-butyl ether [PnB] or dipropylene glycol n-butyl ether [DPnB] in order to keep flammability from being imparted due to mixing of propylene glycol based solvents.

<<Machine Oil Cleaning Test (2)>>

Next, a test for examining the performance to clean machine oil for when nitromethane, nitroethane, 3-methoxybutyl acetate, 3-methoxy-1-butanol, or d-limonene is mixed to a mixed solvent of 1,1,1,3,3-pentafluorobutane and a propylene glycol based solvent will be described. In order to ascertain the improvement in cleaning ability caused by mixing of these solvents, in this test, a case in which the mixing amount of propylene glycol based solvent is 10 wt % or lower, in which case the cleaning effect was not so favorable, has been adopted for examination.

In the same way as the test described above, the test was carried out by preparing test pieces made of SUS-304 (length 25 mm×width 30 mm×thickness 2 mm), immersing these test pieces into machine oil (CQ-30: made by Nippon Oil Co., Ltd.), then immersing them into each cleaning fluid for approximately 3 minutes, then subjecting the test pieces to a drying process, and then examining the cleansing state of the test pieces. The test results are shown in the following tables 13 through 15.

TABLE 13

MACHINE OIL CLEANING TEST 5 (365mfc, PM, nitroethane, nitromethane, 3-MBA, 3-M-1-B, d-limonene)

| | 365mfc (wt %) | PM (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| A | 85 | 10 | 5 | — | — | — | — | ○ |
| B | 85 | 5 | 10 | — | — | — | — | ◎ |
| C | 90 | 5 | 5 | — | — | — | — | X |
| D | 85 | 10 | — | 5 | — | — | — | ○ |
| E | 85 | 5 | — | 10 | — | — | — | ◎ |
| F | 90 | 5 | — | 5 | — | — | — | X |
| G | 85 | 10 | — | — | 5 | — | — | ○ |
| H | 85 | 5 | — | — | 10 | — | — | ◎ |
| I | 90 | 5 | — | — | 5 | — | — | X |
| J | 85 | 10 | — | — | — | 5 | — | ○ |
| K | 85 | 5 | — | — | — | 10 | — | ◎ |
| L | 90 | 5 | — | — | — | 5 | — | X |
| M | 85 | 10 | — | — | — | — | 5 | ○ |
| N | 85 | 5 | — | — | — | — | 10 | ○ |
| O | 90 | 5 | — | — | — | — | 5 | X |

X: cleaning effect small
○: good
◎: very good
365mfc: 1,1,1,3,3-pentafluorobutane ($C_4H_5F_5$)
PM: propylene glycol methyl ether
3-MBA: 3-methoxybutyl acetate
3-M-1-B: 3-methoxy-1-butanol

TABLE 14

MACHINE OIL CLEANING TEST 6 (365mfc, PnB, nitroethane, nitromethane, 3-MBA, 3-M-1-B, d-limonene)

| | 365mfc (wt %) | PnB (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| A | 85 | 10 | 5 | — | — | — | — | ○ |
| B | 85 | 5 | 10 | — | — | — | — | ◎ |
| C | 90 | 5 | 5 | — | — | — | — | X |
| D | 85 | 10 | — | 5 | — | — | — | ○ |
| E | 85 | 5 | — | 10 | — | — | — | ◎ |
| F | 90 | 5 | — | 5 | — | — | — | X |
| G | 85 | 10 | — | — | 5 | — | — | ○ |
| H | 85 | 5 | — | — | 10 | — | — | ◎ |
| I | 90 | 5 | — | — | 5 | — | — | X |
| J | 85 | 10 | — | — | — | 5 | — | ○ |
| K | 85 | 5 | — | — | — | 10 | — | ◎ |
| L | 90 | 5 | — | — | — | 5 | — | X |
| M | 85 | 10 | — | — | — | — | 5 | ○ |
| N | 85 | 5 | — | — | — | — | 10 | ○ |
| O | 90 | 5 | — | — | — | — | 5 | X |

X: cleaning effect small
○: good
◎: very good
365mfc: 1,1,1,3,3-pentafluorobutane ($C_4H_5F_5$)
PnB: propylene glycol n-butyl ether
3-MBA: 3-methoxybutyl acetate
3-M-1-B: 3-methoxy-1-butanol

TABLE 15

MACHINE OIL CLEANING TEST 7 (365mfc, DPnB, nitroethane, nitromethane, 3-MBA, 3-M-1-B, d-limonene)

| | 365mfc (wt %) | DPnB (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| A | 85 | 10 | 5 | — | — | — | — | ○ |
| B | 85 | 5 | 10 | — | — | — | — | ◎ |
| C | 90 | 5 | 5 | — | — | — | — | X |

TABLE 15-continued

| | MACHINE OIL CLEANING TEST 7 (365mfc, DPnB, nitroethane, nitromethane, 3-MBA, 3-M-1-B, d-limonene) | | | | | | | |
|---|---|---|---|---|---|---|---|---|
| | 365mfc (wt %) | DPnB (wt %) | nitro-methane (wt %) | nitro-ethane (wt %) | 3-MBA (wt %) | 3-M-1-B (wt %) | d-limonene (wt %) | results |
| D | 85 | 10 | — | 5 | — | — | — | ○ |
| E | 85 | 5 | — | 10 | — | — | — | ◎ |
| F | 90 | 5 | — | 5 | — | — | — | X |
| G | 85 | 10 | — | — | 5 | — | — | ○ |
| H | 85 | 5 | — | — | 10 | — | — | ◎ |
| I | 90 | 5 | — | — | 5 | — | — | X |
| J | 85 | 10 | — | — | — | 5 | — | ○ |
| K | 85 | 5 | — | — | — | 10 | — | ◎ |
| L | 90 | 5 | — | — | — | 5 | — | X |
| M | 85 | 10 | — | — | — | — | 5 | ○ |
| N | 85 | 5 | — | — | — | — | 10 | ○ |
| O | 90 | 5 | — | — | — | — | 5 | X |

X: cleaning effect small
○: good
◎: very good
365mfc: 1,1,1,3,3-pentafluorobutane ($C_4H_5F_5$)
DPnB: dipropylene glycol n-butyl ether
3-MBA: 3-methoxybutyl acetate
3-M-1-B: 3-methoxy-1-butanol From these test results, it has been confirmed that, by mixing either nitromethane, nitroethane, 3-methoxybutyl acetate, 3-methoxy-1-butanol, or d-limonene, the cleaning ability improves compared to a case in which only propylene glycol based solvents are mixed. Further, as for the mixing amount of these solvents, it was found that it is preferable to set the amount to at least 5 wt % or more when 1,1,1,3,3-pentafluorobutane (365 mfc) is 85 wt %.

<<Flux Cleaning Test (2)>>

Next, a flux cleaning test for a case in which nitromethane, nitroethane, 3-methoxybutyl acetate, 3-methoxy-1-butanol, or d-limonene is mixed will be described. Also in this case, in order to ascertain the improvement in cleaning ability caused by mixing of these solvents, a case in which the mixing amount of propylene glycol based solvent is 20 wt % or lower, in which case the cleaning effect was not so favorable, has been adopted for examination.

In the same way as the test described above, in this test, flux (TAMURA F-AL-4 made by TAMURA Corporation) was applied to the whole surface of a printed wiring board for testing, and, after subjecting it to a burning process in an electric furnace at approximately 200° C. for approximately 2 minutes, it was immersed into the cleaning fluid for approximately 3 minutes. Then, after subjecting the printed wiring board to a drying process, the cleansing state was examined. The test results are shown in the following tables 16 through 18.

TABLE 16

| | FLUX CLEANING TEST 5 (365mfc, PM, nitroethane, nitromethane, 3-MBA, 3-M-1-B, d-limonene) | | | | | | | |
|---|---|---|---|---|---|---|---|---|
| | 365mfc (wt %) | PM (wt %) | nitro-methane (wt %) | nitro-ethane (wt %) | 3-MBA (wt %) | 3-M-1-B (wt %) | d-limonene (wt %) | results |
| A | 75 | 20 | 5 | — | — | — | — | X |
| B | 75 | 15 | 10 | — | — | — | — | X |
| C | 75 | 10 | 15 | — | — | — | — | ○ |
| D | 75 | 5 | 20 | — | — | — | — | ○ |
| E | 75 | 20 | — | 5 | — | — | — | X |
| F | 75 | 15 | — | 10 | — | — | — | X |
| G | 75 | 10 | — | 15 | — | — | — | ○ |
| H | 75 | 5 | — | 20 | — | — | — | ○ |
| I | 75 | 20 | — | — | 5 | — | — | X |
| J | 75 | 15 | — | — | 10 | — | — | X |
| K | 75 | 10 | — | — | 15 | — | — | ○ |
| L | 75 | 5 | — | — | 20 | — | — | ○ |
| M | 75 | 20 | — | — | — | 5 | — | X |
| N | 75 | 15 | — | — | — | 10 | — | X |
| O | 75 | 10 | — | — | — | 15 | — | ○ |
| P | 75 | 5 | — | — | — | 20 | — | ○ |
| Q | 75 | 20 | — | — | — | — | 5 | X |
| R | 75 | 15 | — | — | — | — | 10 | X |

TABLE 16-continued

FLUX CLEANING TEST 5 (365mfc, PM, nitroethane, nitromethane, 3-MBA, 3-M-1-B, d-limonene)

| | 365mfc (wt %) | PM (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| S | 75 | 10 | — | — | — | — | 15 | X |
| T | 75 | 5 | — | — | — | — | 20 | X |

X: cleaning effect small
○: good
365mfc: 1,1,1,3,3-pentafluorobutane ($C_4H_5F_5$)
PM: propylene glycol methyl ether
3-MBA: 3-methoxybutyl acetate
3-M-1-B: 3-methoxy-1-butanol

TABLE 17

FLUX CLEANING TEST 6 (365mfc, PnB, nitroethane, nitromethane, 3-MBA, 3-M-1-B, d-limonene)

| | 365mfc (wt %) | PnB (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| A | 75 | 20 | 5 | — | — | — | — | X |
| B | 75 | 15 | 10 | — | — | — | — | X |
| C | 75 | 10 | 15 | — | — | — | — | ○ |
| D | 75 | 5 | 20 | — | — | — | — | ○ |
| E | 75 | 20 | — | 5 | — | — | — | X |
| F | 75 | 15 | — | 10 | — | — | — | X |
| G | 75 | 10 | — | 15 | — | — | — | ○ |
| H | 75 | 5 | — | 20 | — | — | — | ○ |
| I | 75 | 20 | — | — | 5 | — | — | X |
| J | 75 | 15 | — | — | 10 | — | — | X |
| K | 75 | 10 | — | — | 15 | — | — | ○ |
| L | 75 | 5 | — | — | 20 | — | — | ○ |
| M | 75 | 20 | — | — | — | 5 | — | X |
| N | 75 | 15 | — | — | — | 10 | — | X |
| O | 75 | 10 | — | — | — | 15 | — | ○ |
| P | 75 | 5 | — | — | — | 20 | — | ○ |
| Q | 75 | 20 | — | — | — | — | 5 | X |
| R | 75 | 15 | — | — | — | — | 10 | X |
| S | 75 | 10 | — | — | — | — | 15 | X |
| T | 75 | 5 | — | — | — | — | 20 | X |

X: cleaning effect small
○: good
365mfc: 1,1,1,3,3-pentafluorobutane ($C_4H_5F_5$)
PnB: propylene glycol n-butyl ether
3-MBA: 3-methoxybutyl acetate
3-M-1-B: 3-methoxy-1-butanol

TABLE 18

FLUX CLEANING TEST 7 (365mfc, DPnB, nitroethane, nitromethane, 3-MBA, 3-M-1-B, d-limonene)

| | 365mfc (wt %) | DPnB (wt %) | nitro-methane (wt %) | nitro-ethane (wt %) | 3-MBA (wt %) | 3-M-1-B (wt %) | d-limonene (wt %) | results |
|---|---|---|---|---|---|---|---|---|
| A | 75 | 20 | 5 | — | — | — | — | X |
| B | 75 | 15 | 10 | — | — | — | — | X |
| C | 75 | 10 | 15 | — | — | — | — | ○ |
| D | 75 | 5 | 20 | — | — | — | — | ○ |
| E | 75 | 20 | — | 5 | — | — | — | X |
| F | 75 | 15 | — | 10 | — | — | — | X |
| G | 75 | 10 | — | 15 | — | — | — | ○ |
| H | 75 | 5 | — | 20 | — | — | — | ○ |
| I | 75 | 20 | — | — | 5 | — | — | X |
| J | 75 | 15 | — | — | 10 | — | — | X |
| K | 75 | 10 | — | — | 15 | — | — | ○ |
| L | 75 | 5 | — | — | 20 | — | — | ○ |
| M | 75 | 20 | — | — | — | 5 | — | X |

TABLE 18-continued

| | FLUX CLEANING TEST 7 (365mfc, DPnB, nitroethane, nitromethane, 3-MBA, 3-M-1-B, d-limonene) | | | | | | | |
|---|---|---|---|---|---|---|---|---|
| | 365mfc (wt %) | DPnB (wt %) | nitro-methane (wt %) | nitro-ethane (wt %) | 3-MBA (wt %) | 3-M-1-B (wt %) | d-limonene (wt %) | results |
| N | 75 | 15 | — | — | — | 10 | — | X |
| O | 75 | 10 | — | — | — | 15 | — | ○ |
| P | 75 | 5 | — | — | — | 20 | — | ○ |
| Q | 75 | 20 | — | — | — | — | 5 | X |
| R | 75 | 15 | — | — | — | — | 10 | X |
| S | 75 | 10 | — | — | — | — | 15 | X |
| T | 75 | 5 | — | — | — | — | 20 | X |

X: cleaning effect small
○: good
365mfc: 1,1,1,3,3-pentafluorobutane ($C_4H_5F_5$)
DPnB: dipropylene glycol n-butyl ether
3-MBA: 3-methoxybutyl acetate
3-M-1-B: 3-methoxy-1-butanol From these test results, it has been confirmed that, by mixing either nitromethane, nitroethane, 3-methoxybutyl acetate, or 3-methoxy-1-butanol, the cleaning ability improves compared to a case in which only propylene glycol based solvent(s) (PM, PnB, DPnB) are mixed. Further, as for the mixing amount of nitromethane, nitroethane, 3-methoxybutyl acetate, or 3-methoxy-1-butanol, it has been confirmed that it is preferable to set the amount to 15 wt % or more when 1,1,1,3,3-pentafluorobutane (365 mfc) is 75 wt %. Note that it was not possible to obtain favorable results for d-limonene.

<<Influence on Plastics, Rubbers, Etc.>>

Next, a test for examining the influence of the solvent composition for cleaning according to the present invention on, for example, various kinds of plastics and rubbers was carried out. In this test, soft vinyl chloride, hard vinyl chloride, polycarbonate (PC), acrylic resin, nylon 66 (registered trademark), polyacetal, polyurethane resin, phenolic resin, epoxy resin, melamine resin, urea resin, polyethlyene, and polypropylene were prepared as the plastics, fluoro rubber, chloroprene rubber, silicone rubber, urethane rubber, SBR, natural rubber, and butyl rubber were prepared as the rubbers, and a test of immersing each of them into the cleaning fluid for approximately 6 hours at ordinary temperature was carried out. Then, a drying process was performed and the presence or absence of influence was studied. The test results are shown in the following tables 19 through 22.

TABLE 19

| | INFLUENCE ON PLASTICS, RUBBERS, ETC. 1 (365mfc, nitroethane, nitromethane) | | | | | | | | | |
|---|---|---|---|---|---|---|---|---|---|---|
| | A | B | C | D | E | F | G | H | I | J |
| 365mfc (wt %) | 70 | 60 | 50 | 40 | 30 | 70 | 60 | 50 | 40 | 30 |
| nitroethane (wt %) | 30 | 40 | 50 | 60 | 70 | — | — | — | — | — |
| nitromethane (wt %) | — | — | — | — | — | 30 | 40 | 50 | 60 | 70 |
| vinyl chloride (soft) | ○ | ○ | ○ | X | X | ○ | ○ | X | X | X |
| vinyl chloride (hard) | ○ | ○ | ○ | X | X | ○ | ○ | X | X | X |
| polycarbonate | ○ | ○ | ○ | X | X | ○ | ○ | X | X | X |
| acrylic resin | ○ | ○ | ○ | ○ | ○ | ○ | ○ | ○ | ○ | ○ |
| nylon 66 | ○ | ○ | ○ | ○ | ○ | ○ | ○ | ○ | ○ | ○ |
| polyacetal | ○ | ○ | ○ | ○ | ○ | ○ | ○ | ○ | ○ | ○ |
| polyurethane resin | ○ | ○ | ○ | ○ | ○ | ○ | ○ | ○ | ○ | ○ |
| phenolic resin | ○ | ○ | ○ | ○ | ○ | ○ | ○ | ○ | ○ | ○ |
| epoxy resin | ○ | ○ | ○ | ○ | ○ | ○ | ○ | ○ | ○ | ○ |

TABLE 19-continued

| | INFLUENCE ON PLASTICS, RUBBERS, ETC. 1 (365mfc, nitroethane, nitromethane) | | | | | | | | | |
|---|---|---|---|---|---|---|---|---|---|---|
| | A | B | C | D | E | F | G | H | I | J |
| melamine resin | ○ | ○ | ○ | ○ | ○ | ○ | ○ | ○ | ○ | ○ |
| urea resin | ○ | ○ | ○ | ○ | ○ | ○ | ○ | ○ | ○ | ○ |
| polyethylene | ○ | ○ | ○ | ○ | ○ | ○ | ○ | ○ | ○ | ○ |
| polypropylene | ○ | ○ | ○ | ○ | ○ | ○ | ○ | ○ | ○ | ○ |
| fluoro rubber | ○ | ○ | ○ | ○ | ○ | ○ | ○ | ○ | ○ | ○ |
| chloroprene rubber | ○ | ○ | ○ | X | X | ○ | ○ | ○ | X | X |
| silicone rubber | ○ | ○ | ○ | ○ | ○ | ○ | ○ | ○ | ○ | ○ |
| urethane rubber | ○ | ○ | ○ | ○ | ○ | ○ | ○ | ○ | ○ | ○ |
| SBR | ○ | ○ | ○ | X | X | ○ | ○ | ○ | X | X |
| natural rubber | ○ | ○ | ○ | X | X | ○ | ○ | ○ | X | X |
| butyl rubber | ○ | ○ | ○ | X | X | ○ | ○ | ○ | X | X |

○: no influence
X: having influence
365mfc: 1,1,1,3,3-pentafluorobutane ($C_4H_5F_5$)

TABLE 20

| | INFLUENCE ON PLASTICS, RUBBERS, ETC. 2 (365mfc, d-limonene, 3-MBA) | | | | | | | | | |
|---|---|---|---|---|---|---|---|---|---|---|
| | A | B | C | D | E | F | G | H | I | J |
| 365mfc (wt %) | 70 | 60 | 50 | 40 | 30 | 70 | 60 | 50 | 40 | 30 |
| d-limonene (wt %) | 30 | 40 | 50 | 60 | 70 | — | — | — | — | — |
| 3-MBA (wt %) | — | — | — | — | — | 30 | 40 | 50 | 60 | 70 |
| vinyl chloride (soft) | ○ | ○ | ○ | X | X | ○ | ○ | X | X | X |
| vinyl chloride (hard) | ○ | ○ | ○ | X | X | ○ | ○ | X | X | X |
| polycarbonate | ○ | ○ | ○ | X | X | ○ | ○ | X | X | X |
| acrylic resin | ○ | ○ | ○ | ○ | ○ | ○ | ○ | ○ | ○ | ○ |
| nylon 66 | ○ | ○ | ○ | ○ | ○ | ○ | ○ | ○ | ○ | ○ |
| polyacetal | ○ | ○ | ○ | ○ | ○ | ○ | ○ | ○ | ○ | ○ |
| polyurethane resin | ○ | ○ | ○ | ○ | ○ | ○ | ○ | ○ | ○ | ○ |
| phenolic resin | ○ | ○ | ○ | ○ | ○ | ○ | ○ | ○ | ○ | ○ |
| epoxy resin | ○ | ○ | ○ | ○ | ○ | ○ | ○ | ○ | ○ | ○ |
| melamine resin | ○ | ○ | ○ | ○ | ○ | ○ | ○ | ○ | ○ | ○ |
| urea resin | ○ | ○ | ○ | ○ | ○ | ○ | ○ | ○ | ○ | ○ |
| polyethylene | ○ | ○ | ○ | ○ | ○ | ○ | ○ | ○ | ○ | ○ |
| polypropylene | ○ | ○ | ○ | ○ | ○ | ○ | ○ | ○ | ○ | ○ |
| fluoro rubber | ○ | ○ | ○ | ○ | ○ | ○ | ○ | ○ | ○ | ○ |
| chloroprene rubber | ○ | ○ | ○ | X | X | ○ | ○ | ○ | X | X |
| silicone rubber | ○ | ○ | ○ | ○ | ○ | ○ | ○ | ○ | ○ | ○ |
| urethane rubber | ○ | ○ | ○ | ○ | ○ | ○ | ○ | ○ | ○ | ○ |
| SBR | ○ | ○ | ○ | X | X | ○ | ○ | ○ | X | X |

TABLE 20-continued

| INFLUENCE ON PLASTICS, RUBBERS, ETC. 2 (365mfc, d-limonene, 3-MBA) | A | B | C | D | E | F | G | H | I | J |
|---|---|---|---|---|---|---|---|---|---|---|
| natural rubber | ○ | ○ | ○ | X | X | ○ | ○ | ○ | X | X |
| butyl rubber | ○ | ○ | ○ | X | X | ○ | ○ | ○ | X | X |

○: no influence
X: having influence
365mfc: 1,1,1,3,3-pentafluorobutane ($C_4H_5F_5$)
3-MBA: 3-methoxybutyl acetate

TABLE 21

| INFLUENCE ON PLASTICS, RUBBERS, ETC. 3 (365mfc, PM, PnB) | A | B | C | D | E | F | G | H | I | J | K | L | M | N | N |
|---|---|---|---|---|---|---|---|---|---|---|---|---|---|---|---|
| 365mfc (wt %) | 80 | 70 | 60 | 50 | 40 | 30 | 25 | 80 | 70 | 60 | 50 | 40 | 30 | 20 | 10 |
| PM (wt %) | 20 | 30 | 40 | 50 | 60 | 70 | 75 | — | — | — | — | — | — | — | — |
| PnB (wt %) | — | — | — | — | — | — | — | 20 | 30 | 40 | 50 | 60 | 70 | 80 | 90 |
| vinyl chloride (soft) | ○ | ○ | ○ | ○ | ○ | ○ | ○ | ○ | ○ | ○ | ○ | ○ | ○ | ○ | ○ |
| vinyl chloride (hard) | ○ | ○ | ○ | ○ | ○ | ○ | ○ | ○ | ○ | ○ | ○ | ○ | ○ | ○ | ○ |
| polycarbonate | ○ | ○ | ○ | ○ | ○ | ○ | ○ | ○ | ○ | ○ | ○ | ○ | ○ | ○ | ○ |
| acrylic resin | ○ | ○ | ○ | ○ | ○ | ○ | ○ | ○ | ○ | ○ | ○ | ○ | ○ | ○ | ○ |
| nylon 66 | ○ | ○ | ○ | ○ | ○ | ○ | ○ | ○ | ○ | ○ | ○ | ○ | ○ | ○ | ○ |
| polyacetal | ○ | ○ | ○ | ○ | ○ | ○ | ○ | ○ | ○ | ○ | ○ | ○ | ○ | ○ | ○ |
| polyurethane resin | ○ | ○ | ○ | ○ | ○ | ○ | ○ | ○ | ○ | ○ | ○ | ○ | ○ | ○ | ○ |
| phenolic resin | ○ | ○ | ○ | ○ | ○ | ○ | ○ | ○ | ○ | ○ | ○ | ○ | ○ | ○ | ○ |
| epoxy resin | ○ | ○ | ○ | ○ | ○ | ○ | ○ | ○ | ○ | ○ | ○ | ○ | ○ | ○ | ○ |
| melamine resin | ○ | ○ | ○ | ○ | ○ | ○ | ○ | ○ | ○ | ○ | ○ | ○ | ○ | ○ | ○ |
| urea resin | ○ | ○ | ○ | ○ | ○ | ○ | ○ | ○ | ○ | ○ | ○ | ○ | ○ | ○ | ○ |
| polyethylene | ○ | ○ | ○ | ○ | ○ | ○ | ○ | ○ | ○ | ○ | ○ | ○ | ○ | ○ | ○ |
| polypropylene | ○ | ○ | ○ | ○ | ○ | ○ | ○ | ○ | ○ | ○ | ○ | ○ | ○ | ○ | ○ |
| fluoro rubber | ○ | ○ | ○ | ○ | ○ | ○ | ○ | ○ | ○ | ○ | ○ | ○ | ○ | ○ | ○ |
| chloroprene rubber | ○ | ○ | ○ | ○ | ○ | ○ | ○ | ○ | ○ | ○ | ○ | ○ | ○ | ○ | ○ |
| silicone rubber | ○ | ○ | ○ | ○ | ○ | ○ | ○ | ○ | ○ | ○ | ○ | ○ | ○ | ○ | ○ |
| urethane rubber | ○ | ○ | ○ | ○ | ○ | ○ | ○ | ○ | ○ | ○ | ○ | ○ | ○ | ○ | ○ |
| SBR | ○ | ○ | ○ | ○ | ○ | ○ | ○ | ○ | ○ | ○ | ○ | ○ | ○ | ○ | ○ |
| natural rubber | ○ | ○ | ○ | ○ | ○ | ○ | ○ | ○ | ○ | ○ | ○ | ○ | ○ | ○ | ○ |
| butyl rubber | ○ | ○ | ○ | ○ | ○ | ○ | ○ | ○ | ○ | ○ | ○ | ○ | ○ | ○ | ○ |

○: no influence
X: having influence
365mfc: 1,1,1,3,3-pentafluorobutane ($C_4H_5F_5$)
PM: propylene glycol methyl ether
PnB: propylene glycol n-butyl ether

TABLE 22

| INFLUENCE ON PLASTICS, RUBBERS, ETC. 4 (365mfc, DPnB) | A | B | C | D | E | F | G | H |
|---|---|---|---|---|---|---|---|---|
| 365mfc (wt %) | 80 | 70 | 60 | 50 | 40 | 30 | 20 | 10 |
| DPnB (wt %) | 20 | 30 | 40 | 50 | 60 | 70 | 80 | 90 |
| vinyl chloride (soft) | ○ | ○ | ○ | ○ | ○ | ○ | ○ | ○ |
| vinyl chloride (hard) | ○ | ○ | ○ | ○ | ○ | ○ | ○ | ○ |
| polycarbonate | ○ | ○ | ○ | ○ | ○ | ○ | ○ | ○ |
| acrylic resin | ○ | ○ | ○ | ○ | ○ | ○ | ○ | ○ |
| nylon 66 | ○ | ○ | ○ | ○ | ○ | ○ | ○ | ○ |
| polyacetal | ○ | ○ | ○ | ○ | ○ | ○ | ○ | ○ |
| polyurethane resin | ○ | ○ | ○ | ○ | ○ | ○ | ○ | ○ |
| phenolic resin | ○ | ○ | ○ | ○ | ○ | ○ | ○ | ○ |
| epoxy resin | ○ | ○ | ○ | ○ | ○ | ○ | ○ | ○ |
| melamine resin | ○ | ○ | ○ | ○ | ○ | ○ | ○ | ○ |
| urea resin | ○ | ○ | ○ | ○ | ○ | ○ | ○ | ○ |
| polyethylene | ○ | ○ | ○ | ○ | ○ | ○ | ○ | ○ |
| polypropylene | ○ | ○ | ○ | ○ | ○ | ○ | ○ | ○ |

TABLE 22-continued

| INFLUENCE ON PLASTICS, RUBBERS, ETC. 4 (365mfc, DPnB) | A | B | C | D | E | F | G | H |
|---|---|---|---|---|---|---|---|---|
| fluoro rubber | ○ | ○ | ○ | ○ | ○ | ○ | ○ | ○ |
| chloroprene rubber | ○ | ○ | ○ | ○ | ○ | ○ | ○ | ○ |
| silicone rubber | ○ | ○ | ○ | ○ | ○ | ○ | ○ | ○ |
| urethane rubber | ○ | ○ | ○ | ○ | ○ | ○ | ○ | ○ |
| SBR | ○ | ○ | ○ | ○ | ○ | ○ | ○ | ○ |
| natural rubber | ○ | ○ | ○ | ○ | ○ | ○ | ○ | ○ |
| butyl rubber | ○ | ○ | ○ | ○ | ○ | ○ | ○ | ○ |

○: no influence
X: having influence
365mfc: 1,1,1,3,3-pentafluorobutane ($C_4H_5F_5$)
DPnB: dipropylene glycol n-butyl ether From these test results, it was confirmed that there is no possibility that the solvent composition for cleaning according to the present invention will have a bad influence on the various kinds of plastics or rubbers.

<<Metal Corrosion Test>>

In this test, according to JIS-K1600, aluminum pieces (JIS-H-4000, A1100P) were arranged in both the liquid phase portion and the gas phase portion of the cleaning fluid after cleaning, and the state of corrosion of metal after approximately 48 hours was studied. The results are shown in the following tables 23 and 24.

TABLE 23

METAL CORROSION TEST 1 (365mfc, nitroethane, nitromethane, d-limonene, 3-MBA)

| | 365mfc (wt %) | nitro-ethane (wt %) | nitro-methane (wt %) | d-limonene (wt %) | 3-MBA (wt %) | results |
|---|---|---|---|---|---|---|
| A | 70 | 30 | — | — | — | ○ |
| B | 60 | 40 | — | — | — | ○ |
| C | 50 | 50 | — | — | — | ○ |
| D | 40 | 60 | — | — | — | ○ |
| E | 30 | 70 | — | — | — | ○ |
| F | 70 | — | 30 | — | — | ○ |
| G | 60 | — | 40 | — | — | ○ |
| H | 50 | — | 50 | — | — | ○ |
| I | 40 | — | 60 | — | — | ○ |
| J | 30 | — | 70 | — | — | ○ |
| K | 70 | — | — | 30 | — | ○ |
| L | 60 | — | — | 40 | — | ○ |
| M | 50 | — | — | 50 | — | ○ |
| N | 40 | — | — | 60 | — | ○ |
| O | 30 | — | — | 70 | — | ○ |
| P | 70 | — | — | — | 30 | ○ |
| Q | 60 | — | — | — | 40 | ○ |
| R | 50 | — | — | — | 50 | ○ |
| S | 40 | — | — | — | 60 | ○ |
| T | 30 | — | — | — | 70 | ○ |

X: CORROSION
○: NO CORROSION
365mfc: 1,1,1,3,3-pentafluorobutane ($C_4H_5F_5$)
3-MBA: 3-methoxybutyl acetate

TABLE 24

METAL CORROSION TEST 2 (365mfc, PM, PnB, DPnB)

| | 365mfc (wt %) | PM (wt %) | PnB (wt %) | DPnB (wt %) | results |
|---|---|---|---|---|---|
| A | 80 | 20 | — | — | ○ |
| B | 60 | 40 | — | — | ○ |
| C | 50 | 50 | — | — | ○ |
| D | 40 | 60 | — | — | ○ |
| E | 30 | 70 | — | — | ○ |
| F | 25 | 75 | — | — | ○ |
| G | 80 | — | 20 | — | ○ |
| H | 60 | — | 40 | — | ○ |
| I | 50 | — | 50 | — | ○ |
| J | 30 | — | 70 | — | ○ |
| K | 20 | — | 80 | — | ○ |
| L | 10 | — | 90 | — | ○ |
| M | 80 | — | — | 20 | ○ |
| N | 60 | — | — | 40 | ○ |
| O | 50 | — | — | 50 | ○ |
| P | 30 | — | — | 70 | ○ |
| Q | 20 | — | — | 80 | ○ |
| R | 10 | — | — | 90 | ○ |

X: CORROSION
○: NO CORROSION
365mfc: 1,1,1,3,3-pentafluorobutane ($C_4H_5F_5$)
PM: propylene glycol methyl ether
PnB: propylene glycol n-butyl ether
DPnB: dipropylene glycol n-butyl ether From these test results, it was confirmed that none of the solvent compositions for cleaning according to the present invention has no such bed influence as to make metal corrode.

INDUSTRIAL APPLICABILITY

According to the first solvent composition for cleaning of the present invention, by including nitromethane, nitroethane, d-limonene, and/or 3-methoxybutyl acetate in 1,1,1,3,3-pentafluorobutane, it is possible to greatly increase the cleaning ability, especially the degreasing-cleaning ability, and it is possible to fully achieve sufficient performances in various kinds of cleaning. Further, since the solvent composition does not have flammability, it does not fall within hazardous materials; therefore, it is safe and easy to handle. Also, its ozone depletion potential (ODP) and its global warming potential (GWP) are small, and thus it is ecological and clean.

Further, according to the second solvent composition for cleaning of the present invention, by including (a) 30 through 70 wt % of 1,1,1,3,3-pentafluorobutane and (b) 30 through 70 wt % of one kind of solvent or a mixed solvent including at least two kinds of solvents selected from among nitromethane, nitroethane, d-limonene, and 3-methoxybutyl acetate, it is possible to avoid a situation in which the mixing amount of nitromethane, nitroethane, d-limonene, or 3-methoxybutyl acetate is too small and a sufficient increase in cleaning ability cannot be achieved. Also, it is possible to prevent a situation in which the mixing amount of these solvents is too large and flammability is imparted.

Further, according to the third solvent composition for cleaning of the present invention, by including one kind of solvent or a mixed solvent including at least two kinds of solvents selected from among nitromethane, nitroethane, d-limonene, and 3-methoxybutyl acetate within a range of 40 through 70 wt %, it is possible to sufficiently support flux cleaning.

Further, according to the fourth solvent composition for cleaning of the present invention, by including 1,1,1,3,3-pentafluorobutane and a propylene glycol based solvent, it is possible to greatly increase the cleaning ability, especially the degreasing-cleaning ability, and it is possible to fully achieve sufficient performances as various kinds of cleaners. Further, propylene glycol based solvents are not toxic, and thus extremely safe and easy to handle. Also, they do not include chlorine or fluorine in their molecular structure and their ozone depletion potential (ODP) and their global warming potential (GWP) are small. Therefore, they have superior characteristics in that they are ecological and clean. Further, thanks to their being combined with 1,1,1,3,3-pentafluorobutane, it is possible to overcome the problem of flammability, which is a drawback of propylene glycol based solvent(s), and it is possible to make it into a non-combustible that is safe and has no flammability.

Further, according to the fifth solvent composition for cleaning of the present invention, by adopting (a) 10 through 80 wt % of 1,1,3,3,-pentafluorobutane and (c) 20 through 90 wt % of one kind or at least two kinds of propylene glycol based solvents, it is possible to avoid a situation in which the mixing amount of the propylene glycol based solvent(s) is too small and a sufficient increase in cleaning ability cannot be achieved, and also, it is possible to prevent a situation in which the mixing amount of the propylene glycol based solvent(s) is too large and flammability is imparted.

Further, according to the sixth solvent composition for cleaning of the present invention, by including one kind or at least two kinds of propylene glycol based solvents within a range of 30 through 90 wt %, it is possible to sufficiently support flux cleaning.

Further, as for the fourth through sixth solvent compositions for cleaning, by including (d) at least one kind of solvent selected from among nitromethane, nitroethane, 3-methoxybutyl acetate, 3-methoxy-1-butanol, and d-limonene, it is possible to further increase the dissolution ability, and thus it is possible to fully achieve a superior cleaning ability.

The invention claimed is:

1. A solvent composition for cleaning including:

(a) 30 through 70 wt % of 1,1,1,3,3-pentafluorobutane; and (b) 30 through 70 wt % of one kind of solvent or a mixed solvent including at least two kinds of solvents selected from among nitromethane, nitroethane, d-limonene, and 3-methoxybutyl acetate.

2. A solvent composition for cleaning including:

(a) 30 through 60 wt % of 1,1,1,3,3-pentafluorobutane; and (b) 40 through 70 wt % of one kind of solvent or a mixed solvent including at least two kinds of solvents selected from among nitromethane, nitroethane, d-limonene, and 3-methoxybutyl acetate.

* * * * *

UNITED STATES PATENT AND TRADEMARK OFFICE

CERTIFICATE OF CORRECTION

PATENT NO. : 7,091,170 B2
APPLICATION NO. : 10/467581
DATED : August 15, 2006
INVENTOR(S) : Akiyasu Kaneko It is certified that error appears in the above-identified patent and that said Letters Patent is hereby corrected as shown below:

On the title page item (54), and col. 1, line 1, "Washing" should be --Cleaning--

Signed and Sealed this

Thirteenth Day of March, 2007

JON W. DUDAS
*Director of the United States Patent and Trademark Office*